US006324373B1

(12) United States Patent
Park

(10) Patent No.: US 6,324,373 B1
(45) Date of Patent: Nov. 27, 2001

(54) PRE-TRANSFER SYSTEM IN AN IMAGE FORMING APPARATUS

(75) Inventor: Yong-Hwan Park, Kyungsangbuk-do (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/612,308

(22) Filed: Jul. 7, 2000

(30) Foreign Application Priority Data

Jul. 8, 1999 (KR) ..... 99-27484

(51) Int. Cl.[7] ..... G03G 15/16

(52) U.S. Cl. ..... 399/296

(58) Field of Search ..... 399/296, 297

(56) References Cited

FOREIGN PATENT DOCUMENTS 4-143787-A * 5/1992 (JP) .

* cited by examiner

*Primary Examiner*—Quana M. Grainger
(74) *Attorney, Agent, or Firm*—Robert E. Bushnell, Esq.

(57) ABSTRACT

The present invention relates to a pre-transfer system of an image forming apparatus wherein the pre-transfer efficiency is enhanced by a pre-transfer lamp ("PTL") being placed upstream of the delivering path of a recording paper and the light emitted from the PTL being directly scanned to a photosensitive drum. The PTL is placed upstream of the delivering path of the paper, a lens is disposed opposite to a light emitting portion of the PTL, the lens spreading the light emitted from the PTL in the scanning direction of the photosensitive drum and, at the same time, collecting the light in a direction perpendicular to the scanning direction, and a light guide member is disposed at an angle with respect to the lens and the photosensitive drum, the light guide member guiding the light spread and collected by the lens to the surface of the photosensitive drum.

20 Claims, 6 Drawing Sheets

PRE-TRANSFER SYSTEM IN AN IMAGE FORMING APPARATUS

CLAIM OF PRIORITY

This application makes reference to, incorporates the same herein, and claims all benefits accruing under 35 U.S.C. §119 from an application PRE-TRANSFER SYSTEM IN AN IMAGE FORMING APPARATUS for earlier filed in the Korean Industrial Property Office on Jul. 8, 1999 and there duly assigned Serial No. 27484/1999.

BACKGROUND OF THE INVENTION

1. Field of the Invention

The present invention relates to a pre-transfer system of an image forming apparatus, and, more particularly, to a pre-transfer system of an image forming apparatus capable of enhancing the pre-transfer efficiency by placing a pre-transfer lamp ("PTL") upstream of the delivery path of print papers to cause the light emitted from the PTL to be scanned directly onto a photosensitive drum.

2. Description of the Related Art

In general, an image forming apparatus employing an electrophotographic developing technique such as a facsimile, printer or complex machine incorporating multiple features, includes a pick-up roller, an electrification roller, a photosensitive drum, a transfer roller, a developing roller, a supply roller, a fixer and a laser scan unit ("LSU ") for printing certain print data onto a print paper.

In the printing process, the electrification roller electrifies uniformly the photosensitive substance coated on the external surface of the photosensitive drum while rotating, and the light generated from the LSU forms an electrostatic latent image to be printed on the electrified photosensitive drum. Then, a voltage difference is generated between the supply roller to which a higher supply voltage is applied and the developing roller to which a lower voltage is applied. Therefore, negative charges move from the supply roller to the developing roller. In this way, toner supplied to the developing roller is coated on the electrostatic latent image formed on the surface of the photosensitive drum to form a visible image. The high voltage of the transfer roller transfers the visible image formed by the toner coated the surface of the photosensitive drum to the delivered recording paper. The visible image transferred to the recording paper is fixed on the recording paper by the high temperature and high pressure of a heating roller and a pressing roller provided in the fixer, thereby completing the printing process.

At this time, the above-described supply, developing, transfer and electrification voltages are continuously applied to the supply roller, the developing roller, the transfer roller and the electrification roller, respectively, until the printing process is completed. In addition, the heating roller in the fixer is maintained in the turned-on state until the printing process is completed.

On the other hand, the PTL is installed between the developing roller and the transfer roller. Light of 650 nm wavelength generated at the PTL is scanned onto the surface of the photosensitive drum to lower the potential of the toner coated on the photosensitive drum, thereby decreasing the engagement force of the toner to the photosensitive drum and enhancing the transfer efficiency.

That is, the conventional PTL is located downstream of the paper delivering path in the image forming apparatus, and the potential of the toner coated on the surface of the photosensitive drum is increased to a value near the ground level by the light emitted to the toner prior to the pre-transfer operation, thereby decreasing the engagement force of the toner and increasing the transfer efficiency. At this time, the light emitted from a light emitting diode ("LED") in the PTL is focused by a convex lens in a dot pattern on the surface of the photosensitive drum.

In such a conventional pre-transfer system of the image forming apparatus, however, the following problems arise. When the PTL is activated in order to increase the potential of the toner to a value near the ground level at the downstream of the recording paper, since the light emitted from the PTL passes through a separate medium, that is, the printing paper, before it is scanned to a focus position with respect to the photosensitive drum set initially, the light may be refracted or spread due to the medium, thereby resulting in a decrease of the light intensity or a dispersion of light due to the medium. In this case, the intensity of light is reduced. Particularly, since the light emitted from the PTL must pass through the medium, the light intensity decreases and the transfer efficiency is very poor.

Further, since the transmission rate and the light collecting degree are affected by the properties, e.g., thickness, resistance and texture pattern, of the recording paper, the amount of light needs to be varied depending on the kind of recording paper. Therefore, since the kind of recording paper should be identified and the light amount should be controlled on a case by case basis according to the kind of the paper identified, additional sensors and a high performance central processing unit are required.

In addition, since the PTL is placed downstream of the delivering path of the recording paper, the PTL should be located adjacent to the photosensitive drum so as to enhance the transmission rate of the light. In this case, since the scanning width of the light emitted from the light emitting diode in the PTL is narrow, a plurality of light emitting diodes is required, thereby resulting in a complicated structure of the pre-transfer system.

Moreover, since the light emitted from the PTL is transmitted to the paper and then reaches the surface of the photosensitive drum, the lens for collecting the light emitted from the PTL is a convex lens in order to provide a sufficient amount of the light to the photosensitive drum. Thus, the area which the light emitted from PTL reaches becomes very small. In such a focusing method, since the area reached by the light is very small, the number of light emitting diodes that must installed in the pre-transfer system is increased.

SUMMARY OF THE INVENTION

It is, therefore, an object of the present invention to provide an improved image forming apparatus.

A further object of the invention is to provide an improved pre-transfer system of an image forming apparatus.

A further object of the invention is to provide a pre-transfer system of an image forming apparatus wherein the clarity of the image and the transfer efficiency is enhanced.

A still further object of the invention is to provide a pre-transfer system of an image forming apparatus allowing easy installation of the pre-transfer lamp.

Another object of the invention is to provide a pre-transfer system which is simpler in structure.

Yet another object of the invention is to provide a pre-transfer system which does not require variation of the pre-transfer light depending on the kind of recording paper.

Still another object of the invention is to provide a pre-transfer system of an image forming apparatus which achieves a high pre-transfer efficiency with the use of few light emitting diodes.

The present invention is employed in an image forming apparatus including an electrification roller electrifying a surface of a photosensitive drum, a laser scan unit ("LSU") forming an electrostatic latent image on the surface of the photosensitive drum, a developing machine making the electrostatic latent image visible, a pre-transfer lamp ("PTL") reducing the potential of the toner coated on the photosensitive drum, a transfer roller transferring the image to a recording paper, and a fixer fixing the image transferred to the recording paper.

In the present invention, there are provided the following two methods. First, the PTL is placed in a space of the image forming apparatus and the light emitted from the PTL is reflected by a reflection mirror to reach the photosensitive drum.

Second, the PTL is placed at position spaced apart from the photosensitive drum, and a hollow guide member is provided between the PTL and the photosensitive drum, the guide member guiding the light emitted from the PTL to the photosensitive drum.

In accordance with one aspect of the present invention, the PTL is placed upstream of the delivering path of the recording paper; a lens is disposed opposite to a light emitting portion of the PTL, the lens spreading the light emitted from the PTL in the scanning direction of the photosensitive drum and, at the same time, collecting the light in a direction perpendicular to the scanning direction; and a guide member is disposed at an angle with respect to the lens and the photosensitive drum, the guide member guiding the light spread and collected by the lens to the surface of the photosensitive drum.

Preferably, the PTL is placed in a direction perpendicular to the delivering path of the paper. Further, the lens is formed as a unit, and has a flat face for causing the incident light emitted from the PTL to be refracted as a parallel light, and a semicircular cross-section face opposite to the flat face for causing the light to be spread in the scanning direction and, at the same time, be collected in a direction perpendicular to the scanning direction, the lens extending in the scanning direction. Preferably, the guide member is a reflection mirror.

In accordance with another aspect of the present invention, the PTL is placed upstream of the delivering path of the recording paper, and a light guide member is disposed between the PTL and the photosensitive drum, the light guide member guiding the light emitted from the PTL to the surface of the photosensitive drum, spreading the light in the scanning direction and, at the same time, collecting the light in a direction perpendicular to the scanning direction. Preferably, the PTL is placed parallel to the paper with a light emitting face of the PTL disposed opposite to the photosensitive drum.

The light guide member is formed as a unit, and has both end faces of a semicircular cross-section shape, one end face being opposite to the PTL for receiving and spreading the light emitted from the PTL and the other face being opposite to the photosensitive drum for spreading the light in the scanning direction and, at the same time, collecting the light in a direction perpendicular to the scanning direction, the light guide member extending in the scanning direction.

Preferably, the light guide member is made of a plastic material and its inside is empty.

BRIEF DESCRIPTION OF THE DRAWINGS

A more complete appreciation of the invention, and many of the attendant advantages thereof, will be readily apparent as the same becomes better understood by reference to the following detailed description, when considered in conjunction with the accompanying drawings, in which like reference symbols indicate the same or similar components, wherein.

DETAILED DESCRIPTION OF THE PREFERRED EMBODIMENTS

Figure 1:
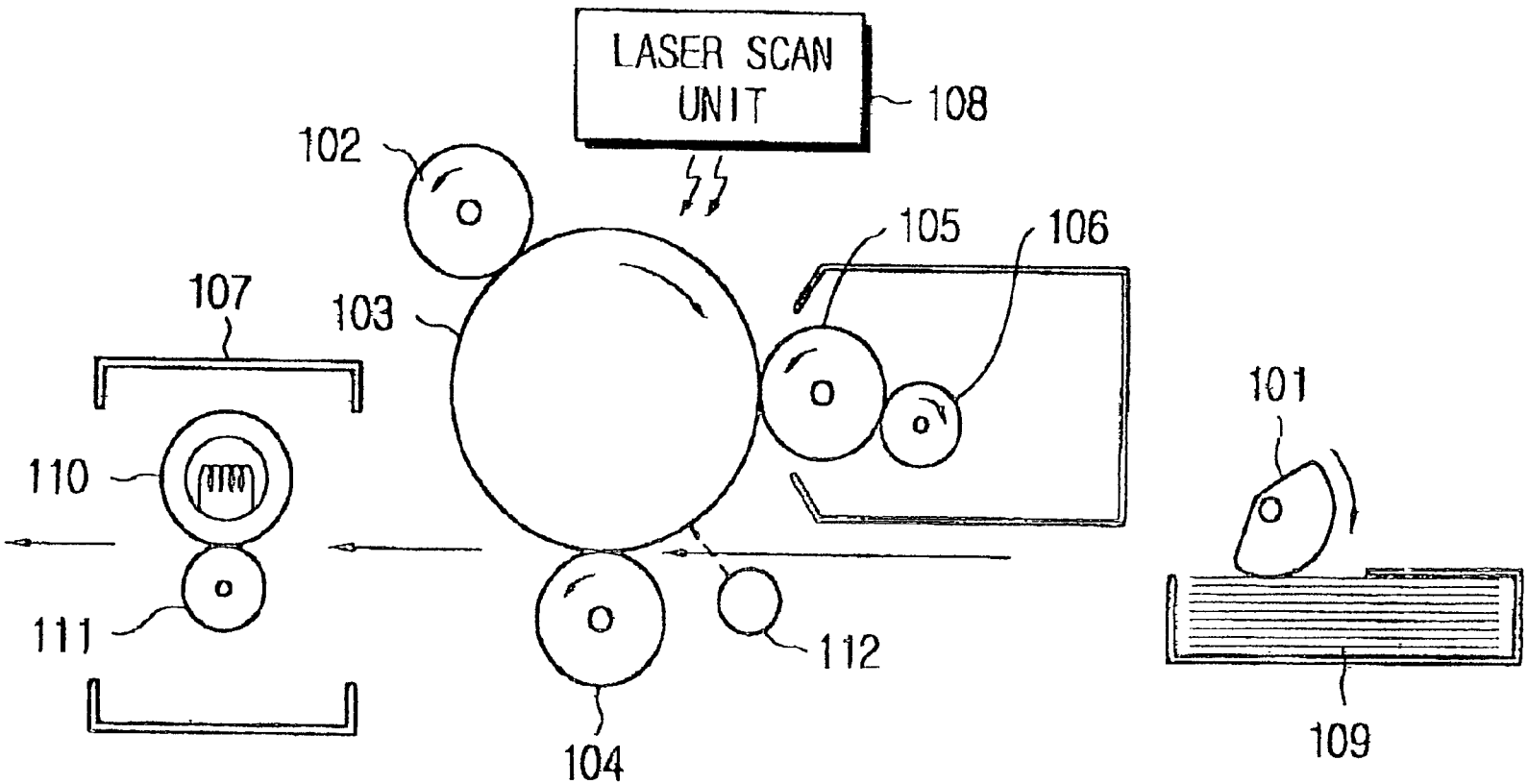
FIG. 1 schematically shows a conventional image forming apparatus employing a electrophotographic developing technique.
Figure 2:
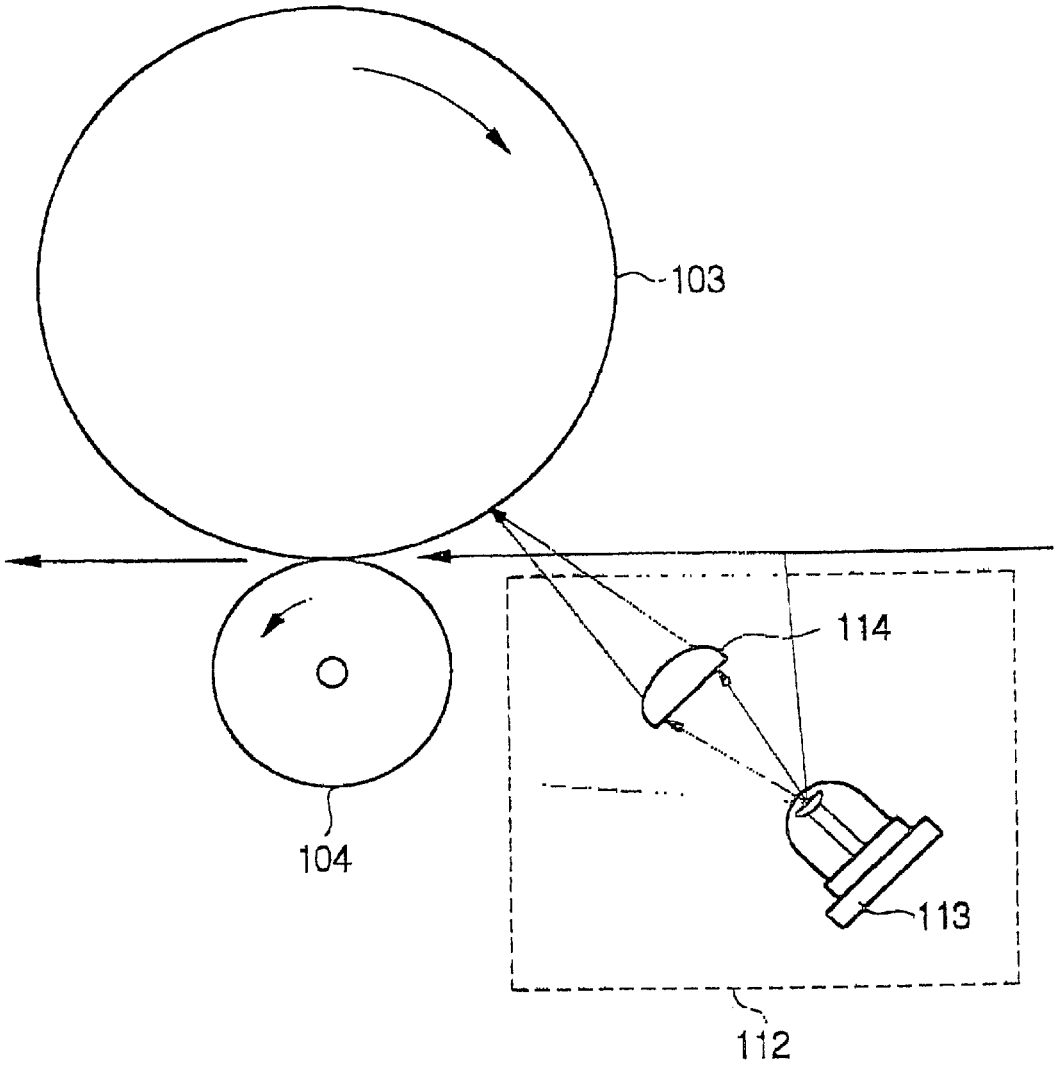
FIG. 2 is a detailed view showing a main part in FIG. 1.

Turning now to the drawings, the general image forming apparatus discussed above is described in detail with reference to FIGS. 1 and 2. FIG. 1 schematically shows a conventional image forming apparatus employing a electrophotographic developing technique. FIG. 2 is a detailed view showing a main part in FIG. 1.

The general image forming apparatus includes a pick-up roller 101, an electrification roller 102, a photosensitive drum 103, a transfer roller 104, a developing roller 105, a supply roller 106, a fixer 107 and a laser scan unit ("LSU") 108 for printing certain print data onto a print paper.

In the printing process, the electrification roller 102 electrifies uniformly the photosensitive substance coated on the external surface of the photosensitive drum 103 while rotating, and the light generated from LSU 108 forms an electrostatic latent image to be printed on the electrified photosensitive drum 103. Then, there is generated a voltage difference between the supply roller 106 to which a higher supply voltage is applied and the developing roller 105 to which a lower voltage is applied. Therefore, negative charges move from the supply roller 106 to the developing roller 105. In this way, toner supplied to the developing roller 105 is coated on the electrostatic latent image formed on the surface of the photosensitive drum 104 to form a visible image. The high voltage of transfer roller 104 transfers the visible image formed by the toner coated the surface of the photosensitive drum 103 to the delivered recording paper 109. The visible image transferred to the recording paper 109 is fixed on the recording paper 109 by the high temperature and high pressure of a heating roller 110 and a pressing roller 111 provided in the fixer 107, thereby completing the printing process.

At this time, the above-described supply, developing, transfer and electrification voltages are continuously applied to the supply roller 106, the developing roller 105, the transfer roller 104 and the electrification roller 102, respectively, until the printing process is completed. In addition, the heating roller 110 in the fixer 107 is maintained in the turned-on state until the printing process is completed.

On the other hand, as shown in FIG. 2, the PTL 112 is installed between the developing roller 105 and the transfer roller 104. The light of 650 nm wavelength generated at the PTL 112 is scanned onto the surface of the photosensitive drum 103 to lower the potential of the toner coated on the photosensitive drum 103, thereby decreasing the engagement force of the toner to the photosensitive drum 103 and enhancing the transfer efficiency.

That is, the conventional PTL 112 is located downstream of the paper delivering path in the image forming apparatus, and the potential of the toner coated on the surface of the photosensitive drum 103 is increased to a value near ground level by the light emitted to the toner prior to the pre-transfer operation, thereby decreasing the engagement force of the toner and increasing the transfer efficiency. At this time, the light emitted from a light emitting diode ("LED") 113 in the PTL 112 is focused by a convex lens 114 in a dot pattern on the surface of the photosensitive drum 103.

A preferred embodiment of the present invention will now be described with reference to the accompanying drawings. It should be noted that like reference numerals indicate like components in the drawings. Although specific components of the circuit are exemplified herein, it will be apparent to those skilled in the art that it is not intended to limit the present invention, and that the present invention may be practiced without the specific components.

Figure 3:
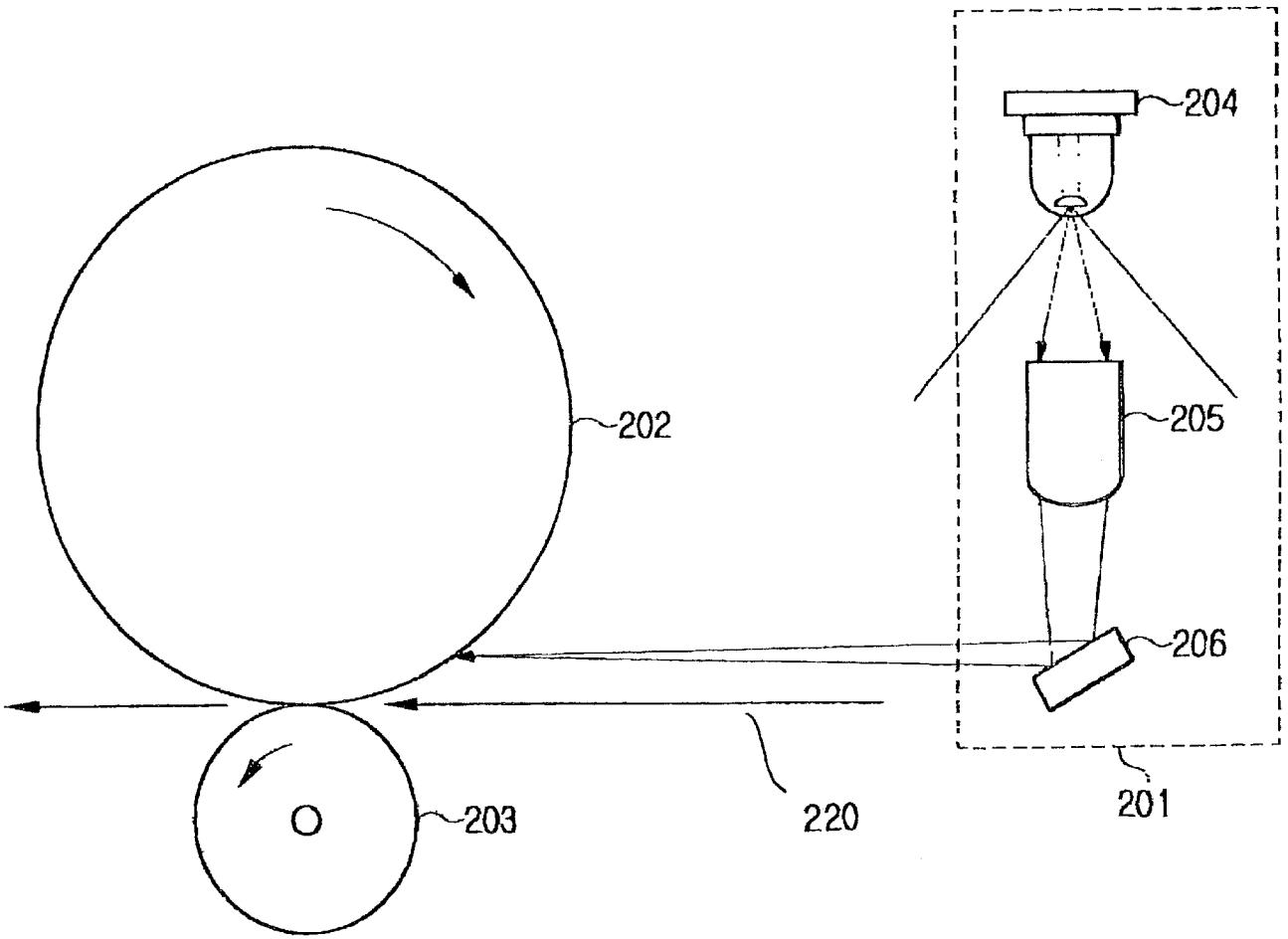
FIG. 3 schematically shows a pre-transfer system of an image forming apparatus in accordance with a first embodiment of the present invention.
Figure 4:
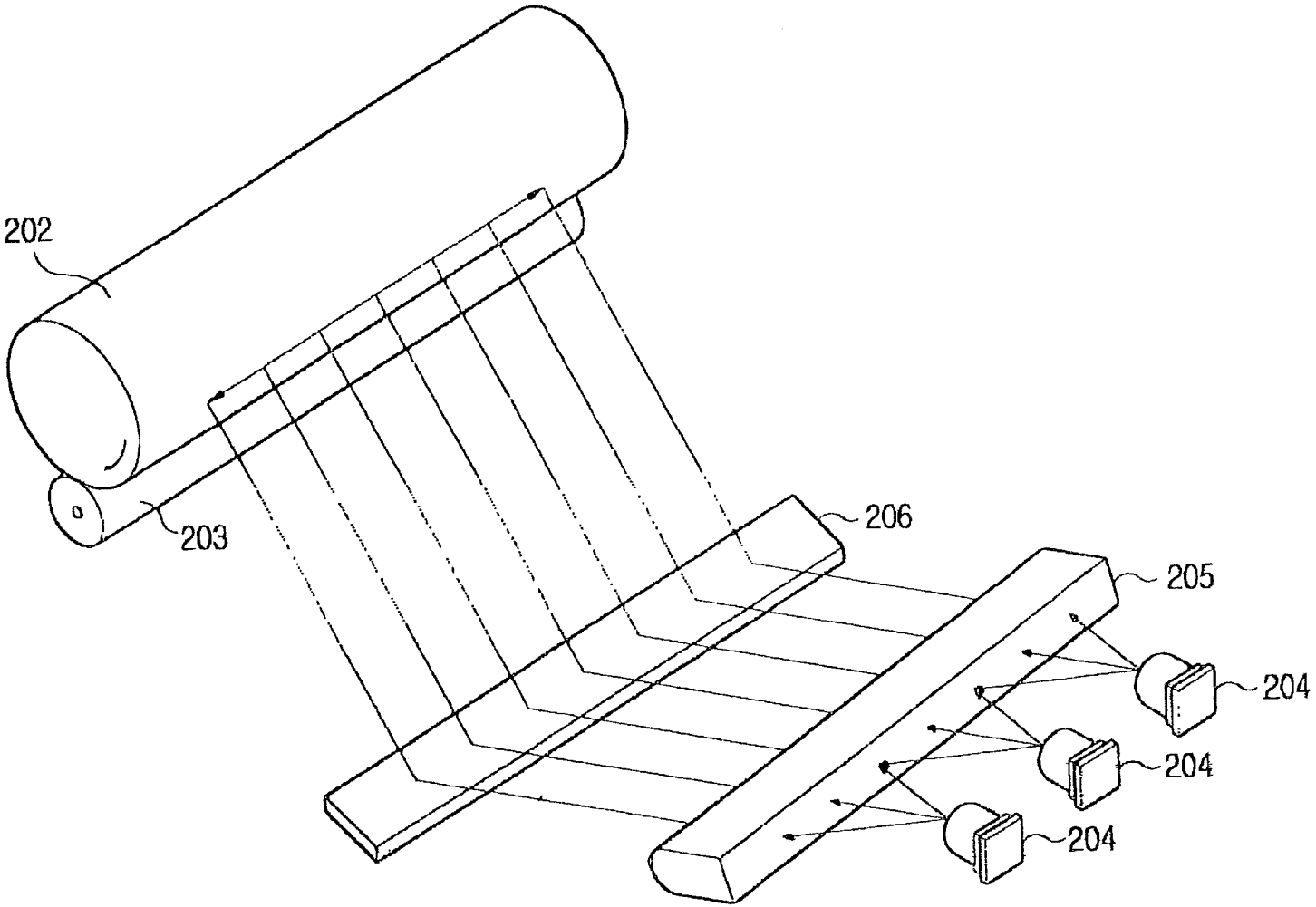
FIG. 4 is a perspective view showing a main part in FIG. 3.

FIG. 3 schematically shows a pre-transfer system of an image forming apparatus in accordance with a first embodiment of the present invention; and FIG. 4 is a perspective view showing a main part in FIG. 3. Referring to FIGS. 3 and 4, a pre-transfer lamp 201 is installed in a vertical direction upstream of the delivering path 220 of a sheet of paper sufficiently spaced from both a photosensitive drum 202 and a transfer roller 203, with each light emitting portion of at least one light emitting diode ("LED") 204 facing the paper. That is, pre-transfer lamp 201 of the invention is installed on the same side of the paper path 220 as photosensitive drum 202, upstream of where the paper is delivered to the nip between transfer roller 203 and photosensitive drum 202.

On the other hand, PTL 201 comprises at least one LED 204, a lens 205 for spreading the light emitted from LED 204 in the scanning direction toward photosensitive drum 202 and, at the same time, collecting the light in a direction perpendicular to the scanning direction, and a reflecting mirror 206 for directing the light spread and collected by lens 205 toward the surface of photosensitive drum 202.

Lens 205, which is formed as a unit, has a flat face opposite to LED 204 and a semicircular cross-section face opposite to the flat face, lens 205 extending in the scanning direction. That is, the lens is semi-cylindrical on the face opposite the flat face. Specifically, the light emitted from LED 204 reaches the flat face of lens 205 and is refracted so as to be a parallel light which is, in turn, collected when passing through the semicircular portion of lens 205. In other words, the configuration of the lens, which is semicircular and perpendicular to the scanning direction, and which is elongate in the scanning direction, spreads the light passing through lens 205 in the scanning direction. At this time, by adjusting the distance between lens 205 and LED 204, the refraction rate or focal length of lens 205, and the distance between lens 205 and photosensitive drum 202, light passing through lens 205 is collected in a direction perpendicular to the scanning direction, and becomes a line extended in the scanning direction focused on photosensitive drum 202.

Further, since the light passing through lens 205 directly reaches the surface of photosensitive drum 202 without passing through a separate medium, a sufficient amount of light which is required in the pre-transfer operation is ensured. Therefore, collection of the light in the scanning direction is not required, and the present invention yields a good pre-transfer efficiency with only a few LEDs 204. That is, since the spreading range of the light emitted from LED 204 is about 80 degrees, the optimal pre-transfer efficiency can be obtained with a minimum number of LEDs 204 by properly adjusting the distance between LED 204 and the lens 205. Typically, although there may be some differences depending on the kind of image forming apparatus, about 18 LEDs are required for a conventional image forming apparatus to perform a pre-transfer operation, whereas in the image forming apparatus according to the present invention, a sufficient pre-transfer effect can be obtained with about three LEDs 204.

Further, since the light emitted from LED 204 is refracted at a refraction angle and then focused onto photosensitive drum 202, the installation angle of PTL 201 may be almost unrestricted by properly adjusting the angle of reflection mirror 205. Therefore, the installation of PTL 201 becomes convenient.

Figure 5:
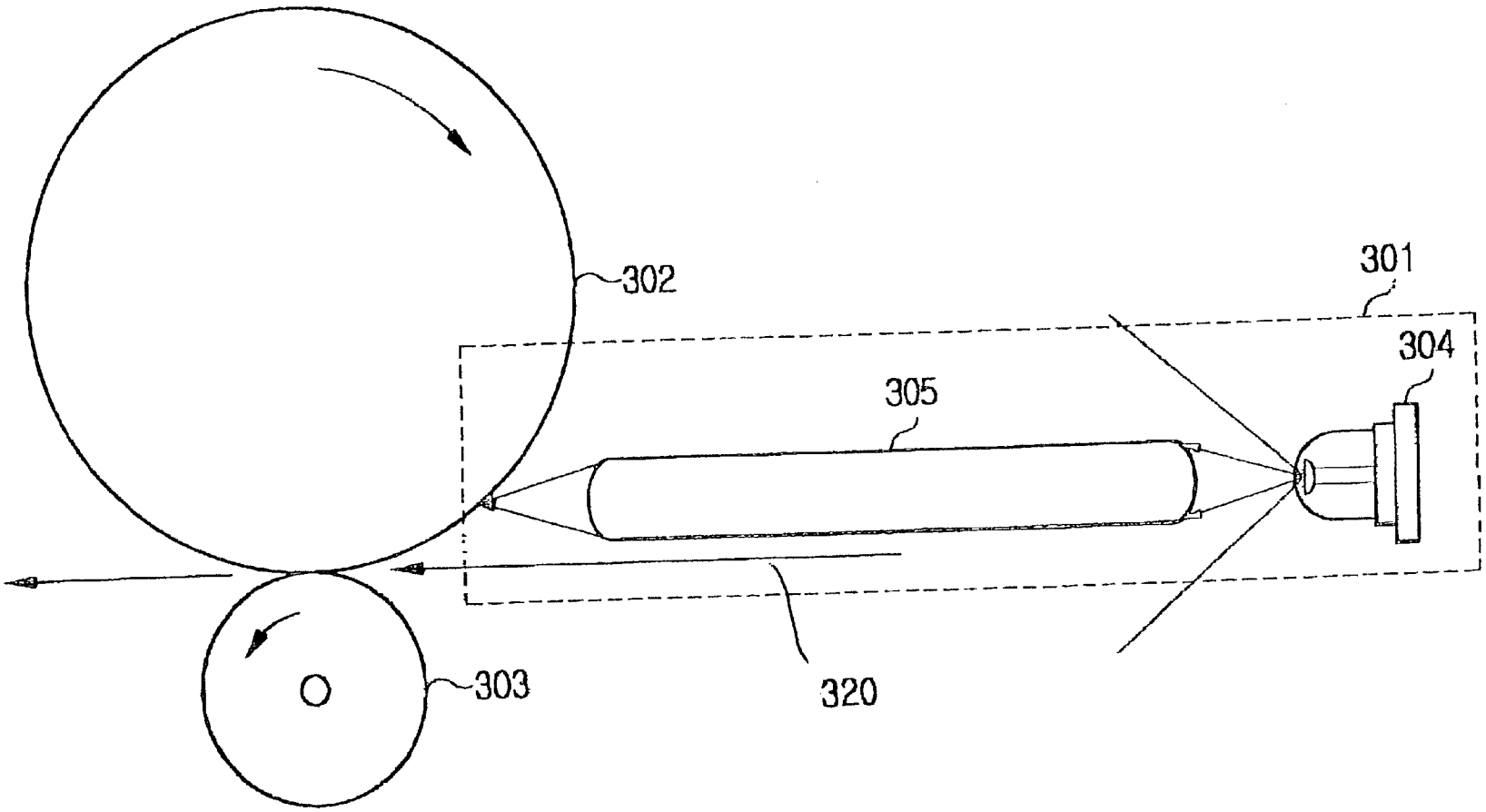
FIG. 5 schematically shows a pre-transfer system of an image forming apparatus in accordance with a second embodiment of the present invention.
Figure 6:
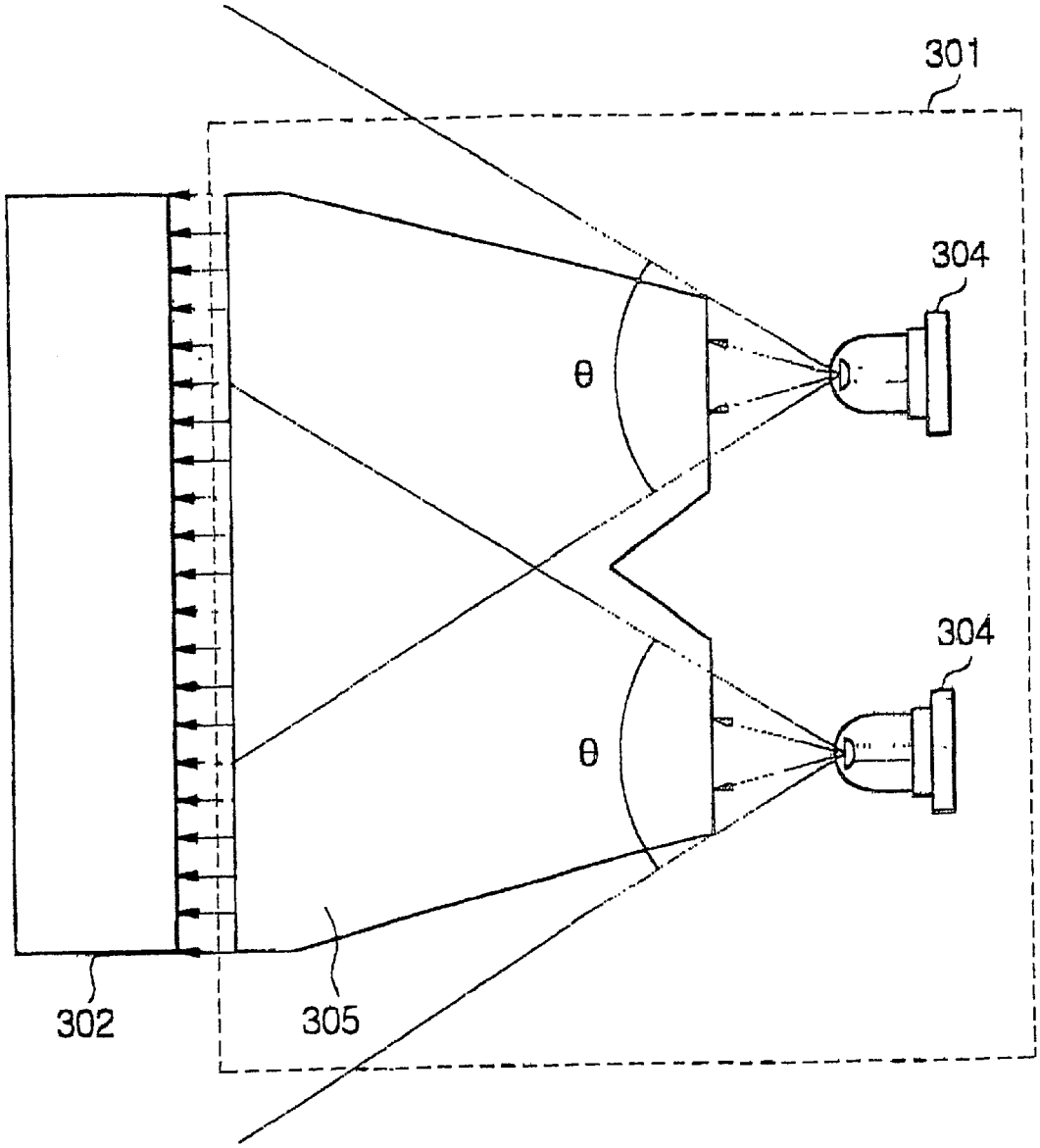
FIG. 6 is a detailed view of FIG. 5.

FIG. 5 schematically shows a pre-transfer system of an image forming apparatus in accordance with the second embodiment of the present invention; and FIG. 6 is a detailed view of FIG. 5. Referring to FIGS. 5 and 6, a PTL 301 is installed in a vertical direction upstream of the delivering path 320 of a sheet of paper sufficiently spaced from both a photosensitive drum 302 and a transfer roller 303, with each light emitting portion of at least one LED 304 facing the paper.

On the other hand, PTL 301 includes at least one LED 304, a light guide member 305 for spreading the light emitted from at least one LED 304 in the scanning direction to photosensitive drum 302 while, at the same time, collecting the light in a direction perpendicular to the scanning direction, and directing the light toward the surface of photosensitive drum 302.

The light guide member 305, which is formed as a unit, extends in the scanning direction of the photosensitive drum and has a semicircular shape at both ends, that is, the ends opposite to LED 304 and the photosensitive drum 304, respectively. Further, the light guide member is empty inside for guiding the light emitted from LED 304 through the inside toward photosensitive drum 302. Therefore, the light path is spread in the scanning direction so as to receive the light spread at the angle $\theta$, which may be approximately 80°, from each of LEDs 304, and light guide 305 spreads the light and, at the same time, collects the light in a direction perpendicular to the scanning direction at the end opposite to photosensitive drum 302. That is, when the light emitted from LED 304 enters light guide member 305, the incident light is spread in the scanning direction by the light path of light guide member 305, and is then guided toward photosensitive drum 302. The light guided by light guide member 305 is collected by the lens shape of light guide member 305 in the direction perpendicular to the scanning direction, and is emitted in a line or band pattern to photosensitive drum 302.

Further, since the light transmitting light guide member 305 directly reaches the surface of photosensitive drum 302 without passing through any separate medium, a sufficient amount of light which is required in the pre-transfer operation is ensured. Therefore, it is not required to collect the light in the scanning direction, thereby obtaining a good pre-transfer efficiency with only a few LEDs 304. That is, since the spread range of light emitted from LED 304 is about 80 degrees, the optimal pre-transfer efficiency can be obtained with a minimum number of LEDs 304 by properly adjusting the length of light guide member 205. At this time, although there may be some difference depending on the kind ofimage forming apparatus, about 18 LEDs are required for the conventional image forming apparatus to perform the pre-transfer operation whereas, in the image forming apparatus according to the present invention, a sufficient pre-transfer effect can be obtained with about two or three LEDs 304.

Further, the light emitted from LED 304 is guided by light guide member 305 to photosensitive drum 302 so that the installation angle of PTL 301 is not restricted by changing the path of light guide member 305. Therefore, the installation of PTL 301 becomes very convenient.

The pre-transfer system of the image forming apparatus in accordance with the present invention has advantages as follows. Since the PTL is installed upstream of the delivering path of the paper and the light emitted from the PTL directly reaches the surface of the photosensitive drum, the clarity of the image and the pre-transfer efficiency is enhanced.

Further, since the PTL is installed upstream of the delivering path of the paper, and the light emitted from the PTL is reflected by the reflection mirror and then reaches the surface of the photosensitive drum, the installation of the PTL is not restricted.

In addition, since the PTL is installed upstream of the delivering path of the paper and the light emitted from the PTL is guided by the light guide member to the surface of the photosensitive drum, the installation of the PTL is not restricted.

Moreover, since the distance between the PTL and the photosensitive drum is sufficient, a high re-transfer efficiency is obtained with only a few LEDs.

Although the invention has been shown and described with respect to the preferred embodiments according to the present invention, it will be understood by those skilled in the art that various changes and modifications may be made without departing from the spirit and scope of the invention as defined in the following claims. Therefore, the present invention should not be limited to the described embodiments and is defined by the appended claims and the equivalent thereof.

What is claimed is:

1. An image forming apparatus, comprising an electrification roller electrifying a surface of a photosensitive drum, a laser scan unit forming an electrostatic latent image on the surface of the photosensitive drum, a developing machine making the electrostatic latent image visible, a pre-transfer lamp reducing the potential of toner coated on the photosensitive drum, a transfer roller transferring the image to a recording paper, and a fixer fixing the image transferred to the recording paper;

wherein the pre-transfer lamp is placed upstream of a delivering path of the recording paper;

wherein a lens is disposed opposite to a light emitting portion of the pre-transfer lamp, the lens spreading light emitted from the pre-transfer lamp in a scanning direction of the photosensitive drum and, at the same time, collecting the light in a direction perpendicular to the scanning direction; and wherein a guide member is disposed at an angle with respect to the lens and the photosensitive drum, the guide member guiding the light spread and collected by the lens toward the surface of the photosensitive drum.

2. The apparatus according to claim 1, wherein the pre-transfer lamp is placed in a direction perpendicular to the delivering path of the paper.

3. The apparatus according to claim 1, wherein the lens is formed as a unit, the lens having a flat face for refracting the light emitted from the pre-transfer lamp to form parallel light, and a semicircular face opposite to the flat face for spreading the light in the scanning direction and, at the same time, collecting the light in a direction perpendicular to the scanning direction, the lens extending in the scanning direction.

4. The apparatus according to claim 1, wherein the guide member is a reflection mirror.

5. An image forming apparatus, comprising an electrification roller electrifying a surface of a photosensitive drum, a laser scan unit forming an electrostatic latent image on the surface of the photosensitive drum, a developing machine making the electrostatic latent image visible, a pre-transfer lamp reducing the potential of toner coated on the photosensitive drum, a transfer roller transferring the image to a recording paper, and a fixer fixing the image transferred to the recording paper;

wherein the pre-transfer lamp is placed upstream of a delivering path of the recording paper; and wherein a light guide member is disposed between the pre-transfer lamp and the photosensitive drum, the light guide member guiding light emitted from the pre-transfer lamp toward the surface of the photosensitive drum, and spreading the light in a scanning direction while, at the same time, collecting the light in a direction perpendicular to the scanning direction.

6. The apparatus according to claim 5, wherein the pre-transfer lamp is placed parallel to the recording paper, a light emitting face of the pre-transfer lamp being disposed facing toward the photosensitive drum.

7. The apparatus according to claim 5, wherein the light guide member is formed as a unit, and has two end faces of a semicircular shape, a first end face being opposite to the pre-transfer lamp for receiving and spreading the light emitted from the pre-transfer lamp, and a second end face being opposite to the photosensitive drum for spreading the light in the scanning direction and, at the same time, collecting the light in a direction perpendicular to the scanning direction, the light guide member extending in the scanning direction.

8. The apparatus according to claim 7, wherein the light guide member is made of a plastic material and has an interior which is empty.

9. An image forming apparatus, comprising:

a photosensitive drum for holding an electrostatic latent image and receiving toner;

a developing roller for applying the toner to the photosensitive drum;

a transfer roller contacting the photosensitive drum for transferring the toner from the photosensitive drum to a recording medium;

a recording medium delivering path extending downstream from a pickup roller toward a nip between said photosensitive drum and said transfer roller; and a pre-transfer lamp located on a same side of the recording medium delivering path as the photosensitive drum, and located upstream of the photosensitive drum, for spreading light in a scanning direction onto the photosensitive drum; wherein said pre-transfer lamp comprises a first light-emitting diode and a mirror for directing the light from the first light-emitting diode toward the photosensitive drum.

10. The image forming apparatus of claim 9, said first light-emitting diode being oriented generally toward the recording medium delivering path.

11. The image forming apparatus of claim 9, said pre-transfer lamp further comprising a lens disposed between the first light-emitting diode and the mirror for spreading the light along the scanning direction, and for focusing the light perpendicular to the scanning direction, onto the photosensitive drum.

12. The image forming apparatus of claim 13, said lens having an elongate flat face facing the first light-emitting diode and a semi-cylindrical face opposite the flat face.

13. The image forming apparatus of claim 12, said pre-transfer lamp further comprising a second light-emitting diode positioned facing a portion along a length of the flat face of said lens different from a portion faced by said first light-emitting diode, said second light-emitting diode supplementing illumination of a scanning region of the photosensitive drum.

14. The image forming apparatus of claim 12, wherein there are three light-emitting diodes positioned along a length of the flat face of said lens.

15. An image forming apparatus, comprising:

a photosensitive drum for holding an electrostatic latent image and receiving toner;

a developing roller for applying the toner to the photosensitive drum;

a transfer roller contacting the photosensitive drum for transferring the toner from the photosensitive drum to a recording medium;

a recording medium delivering path extending downstream from a pickup roller toward a nip between said photosensitive drum and said transfer roller; and a pre-transfer lamp located on a same side of the recording medium delivering path as the photosensitive drum, and located upstream of the photosensitive drum, for spreading light in a scanning direction onto the photosensitive drum, wherein said pre-transfer lamp comprises a first light-emitting diode;

said apparatus further comprising a light guide member positioned between the first light-emitting diode and the photosensitive drum for guiding light from the light-emitting diode, and for focusing the light into a line pattern in a scanning direction on the photosensitive drum.

16. The apparatus of claim 15, said light guide member having a semi-cylindrical face facing the first light-emitting diode and a semi-cylindrical face facing said photosensitive drum.

17. The apparatus of claim 16, said light guide member having an interior which is empty.

18. The apparatus of claim 16, said pre-transfer lamp further comprising a second light-emitting diode oriented to direct light into a portion of the semi-cylindrical face facing the first light-emitting diode.

19. The apparatus of claim 18, wherein said light guide member is positioned to receive a spread of light of approximately 80° emitted from each of said first and second light-emitting diodes.

20. The apparatus of claim 18, wherein there are two light-emitting diodes in the pre-transfer lamp.

* * * * *